US005529196A

United States Patent [19]

Lane

[11] Patent Number: 5,529,196

[45] Date of Patent: Jun. 25, 1996

[54] CARBONATED BEVERAGE CONTAINER WITH FOOTED BASE STRUCTURE

[75] Inventor: Michael T. Lane, Manchester, Mich.

[73] Assignee: Hoover Universal, Inc., Plymouth, Mich.

[21] Appl. No.: 303,855

[22] Filed: Sep. 9, 1994

[51] Int. Cl.[6] ..... B65D 1/02; B65D 23/00

[52] U.S. Cl. ..... 215/375; 215/373; 220/606; 220/609

[58] Field of Search ..... 215/16, 373–375; 220/606, 608

[56] References Cited

U.S. PATENT DOCUMENTS

| | | | |
|---|---|---|---|
| 3,598,270 | 8/1971 | Adomaitis et al. | 215/1 C |
| 3,727,783 | 4/1973 | Carmichael | 215/1 C |
| 4,249,667 | 2/1981 | Pocock et al. | 215/1 C |
| 4,294,366 | 10/1981 | Chang | 215/1 C |
| 4,318,489 | 3/1982 | Snyder et al. | 215/1 C |
| 4,335,821 | 6/1982 | Collette et al. | 215/1 C |
| 4,368,825 | 1/1983 | Motill | 215/1 C |
| 4,785,949 | 11/1988 | Krishnakumar et al. | 215/1 C |
| 4,865,206 | 9/1989 | Behm et al. | 215/1 C |
| 4,867,323 | 9/1989 | Powers | 215/1 C |
| 4,978,015 | 12/1990 | Walker | 215/1 C |
| 5,024,339 | 6/1991 | Riemer | 215/1 C |
| 5,024,340 | 6/1991 | Alberghini et al. | 215/1 C |
| 5,064,080 | 11/1991 | Young et al. | 215/1 C |
| 5,072,841 | 12/1991 | Okhai | 215/1 C |
| 5,139,162 | 8/1992 | Young et al. | 215/1 C |
| 5,160,059 | 11/1992 | Collette et al. | 215/1 C |
| 5,205,434 | 4/1993 | Brunson et al. | 220/608 |
| 5,287,978 | 2/1994 | Young et al. | 215/1 C |
| 5,320,230 | 6/1994 | Hsiung | 215/1 C |

FOREIGN PATENT DOCUMENTS

| | | | |
|---|---|---|---|
| 4044943 | 2/1992 | Japan | 215/1 C |
| 4189739 | 7/1992 | Japan | 215/1 C |
| 2067160 | 7/1981 | United Kingdom | 215/1 C |
| 9200880 | 1/1992 | WIPO | 215/1 C |

*Primary Examiner*—Sue A. Weaver
*Attorney, Agent, or Firm*—Harness, Dickey & Pierce

[57] ABSTRACT

A one piece plastic container for carbonated beverages has a footed base structure. The upper portion of the base structure includes hollow projections between which are formed relatively stiff strap formations. A deformable open region at the upper end of the strap formations is easily deformed and expands in a controlled fashion when the container is pressurized. Outward movement of the open region causes outward movement of the upper ends of the strap formations which then pivot about the feet causing the lower ends of the strap formations and the central region of the base structure to move upwardly.

19 Claims, 10 Drawing Sheets

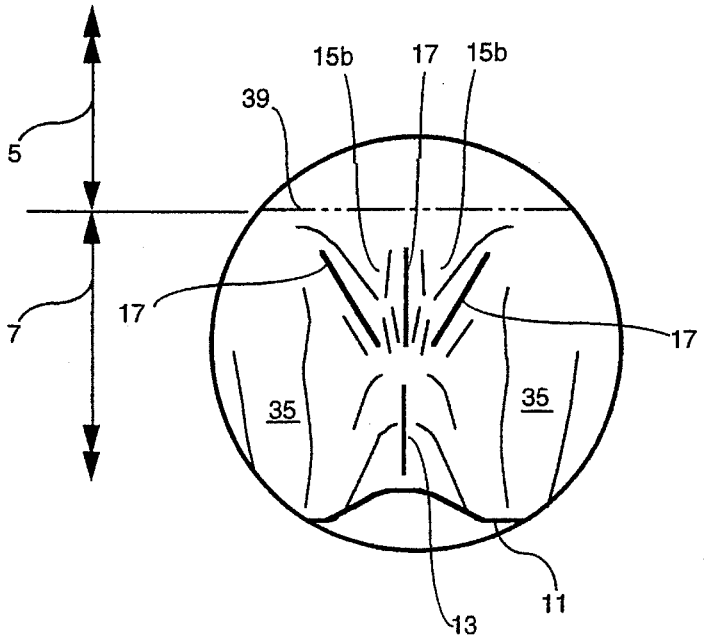
*Fig. 15*
*Fig. 10a*
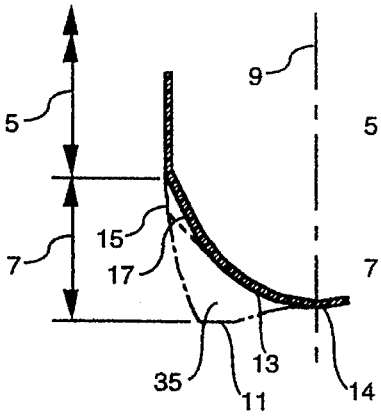
*Fig. 10b*
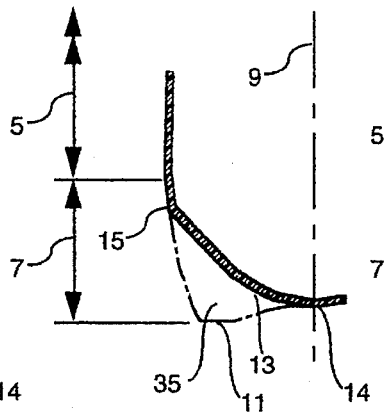
*Fig. 10c*
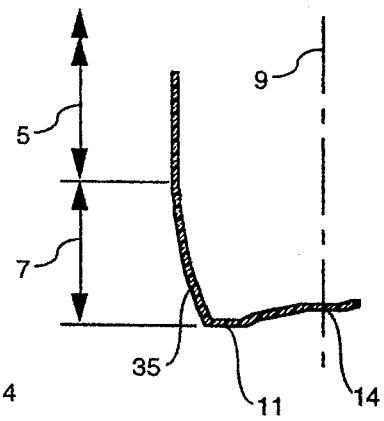

CARBONATED BEVERAGE CONTAINER WITH FOOTED BASE STRUCTURE

BACKGROUND OF THE INVENTION

This in relates generally to a one piece plastic carbonated beverage container with a looted base structure; and particularly, a container of this type molded with a reduced amount of plastic material while maintaining an extended stance of each foot. These containers are usually, although not exclusively, made from a polyethylene terephthalate (PET) polyester material using a blow molding process that biaxially orients and sets its molecular structure.

A major difficulty in a filled and sealed carbonated container is controlling and minimizing the distortion of the looted base structure from the pressure created by the carbonated beverage. Under normal conditions this pressure can exceed 75 PSI (5 bar). Uncontrolled distortion can lead to a variety of problems.

One problem is poor container stability from a "rocker bottom" where the central region of the base bulges downwardly to a point where the supporting feet can not simultaneously contact a supporting surface. In this case the container is supported in a tilted somewhat unstable position by the central region and two of the feet.

Another problem is container damage from buckling, creases, bumps and bulges in the feet and sidewall areas. In some cases this can lead to structural damage from concentrated stresses; in other cases this can lead to an aesthetically unpleasing shape. Containers with concentrated stresses may burst if subjected to impact.

Another problem is an inconsistent fill level line position created by an inconsistent expansion of the container, most of which occurs in the base structure area. Fill line position consistency is important to consumers in that consumers often believe a fill level below standard signifies an underfilled or unsealed container.

Also to be considered is that an untilled container must be able to stand upright in the filling machinery. Containers that fall over during conveying will adversely affect the cost and efficiency of filling operations. Stability is improved with a wide stance of the feet of the base structure. Another consideration is maximization of the area of each foot pad in contact with the conveyor or other supporting surface. Small foot pads tend to become caught and fall over in the machinery.

The prior art describes many examples of one piece plastic carbonated beverage containers with footed base structures. To achieve success, such containers depend on a relatively heavier container with substantial material thickness in the base structure area. The approach uses mass to resist distortion, but heavier containers tend to be costly to produce. When these containers are made with less material many of the problems mentioned above occur. Those containers which tend to be lighter in weight tend to reduce the stance of the feet or reduce the area of each foot pad which often create stability problems before and after filling.

It is therefore desirable to provide a footed carbonated beverage container of reduced material weight with a wide stance of the base structure feet and a large foot pad area while controlling and manipulating the expansion and distortion of the base from the beverage carbonation pressure so as not to adversely affect the consistency of fill line position, aesthetic appearance, and stability or to create excessive concentrated stresses.

SUMMARY OF THE INVENTION

This invention provides a plastic container for carbonated beverages which has a base structure extending downwardly from a generally tubular sidewall. The form of the base structure is developed from several shapes smoothly blended together. The shapes selected satisfy the need for stability when empty and when filled with a carbonated or other beverage and sealed. Pressure from the carbonation is expected to alter the container-as-molded-shape to a new and desirable container-as-filled-and-sealed-shape. In effect the container-as-molded-shape influences or predetermines the form of the new container-as-filled-and-sealed-shape.

In accordance with the invention achieving a desirable shape utilizes the natural tendency of the blow molding process to create a slightly thicker container wall section in areas of the container mold which are contacted first by the expanding parison as it inflates. In the case of the container of this invention the wall thickness of a central region of the base about a longitudinal axis, which blends to adjacent portions of a strap formation and which in turn extends substantially radially from the central region, tend to be thicker than the wall thickness of the container sidewall and the foot pad of each downwardly hollow projection.

The container shape, upon pressurization, is predetermined to expand first in a region of the base structure adjacent to the merge point of the base to the sidewall. The strap formation which separates circumferentially adjacent pairs of support feet is itself partially separated by a downward extending wedge formation also positioned between the circumferentially adjacent pairs of feet. The forces acting on the strap are evenly distributed to the sidewall by this split and by adjacent areas. When viewing the container longitudinally the preferred strap formation assumes a shape similar to a letter Y.

As molded the foot provides a substantially planar surface with a rounded boundary. When pressurized by a carbonated beverage in the sealed container, the planar surface of the foot assumes a somewhat hemispheroidal shape without buckling or creasing.

The footed container of this invention is aesthetically pleasing, provides a stable wide stance support both before and after filling, meets other generally accepted industrial and consumer expectations, and is significantly lighter in weight than containers previously known.

BRIEF DESCRIPTION OF THE DRAWINGS

Further advantages of the invention will become apparent to those skilled in the art from the following description, taken in connection with the accompanying drawings, in which:

FIG. 10*a* is a partial vertical sectional view as seen along line 10*a*—10*a* in FIG. 10 illustrating the strap formation and one of the separated strap formations in relation to a phantom view of the hollow foot projection and a phantom view of the wedge formation;

FIG. 10*b* is a partial vertical sectional view as seen along line 10*b*—10*b* in FIG. 10 illustrating the strap formation and wedge formation in relation to the phantom view of the hollow foot projection;

FIG. 10*c* is a partial vertical sectional view as seen along line 10*c*—10*c* in FIG. 10 illustrating the hollow foot projection.

FIG. 15 is an enlarged elevational view of an another wedge formation alternative with an alternative separated strap formation;

DETAILED DESCRIPTION

Figure 1:
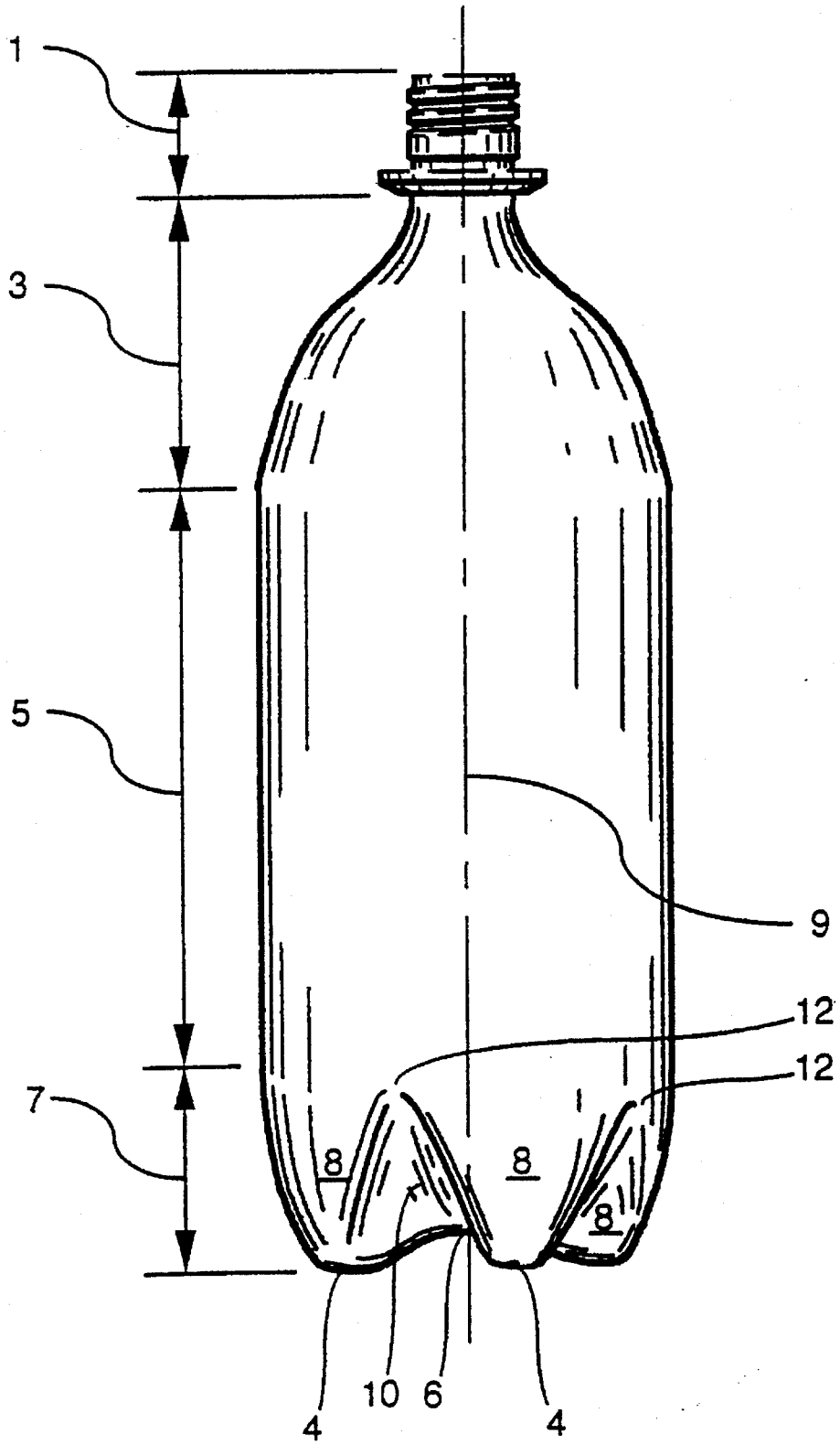
Fig. 1 Prior Art
FIG. 1 is a side elevational view of a prior art container.

With reference to the drawings, FIG. 1 illustrates a shape of a typical one piece looted carbonated beverage container. Generally containers of this type have four broad regions, namely a neck finish (1), a shoulder portion (3), a sidewall portion (5), and a base structure (7). Typically the base structure (7) comprises four, five, or six hollow foot projections (8) which extend downwardly in an arc from the sidewall (5) to provide the support for the container. Between any pair of these foot projections (8) is a formation (10) which in the prior art is often referred to as a rib or a strap. This strap formation of the base structure extends radially outwardly and upwardly from a central region about a longitudinal axis (9) eventually blending with the sidewall (5) with a rounded point like shape (12). A nominal two liter container, for example, will often weigh 55 grams or more.

These prior art containers generally work well, but in applications where the amount of material or weight of the container is reduced, to minimize manufacturing cost, (for example reductions to 50 grams or 48 grams or less in a two liter sized container) distortions can occur from the beverage carbonation pressure that will greatly influence container stability, performance, and aesthetic appeal. These distortions can create unwanted surface buckling, creases, and bulges in areas in the foot projections (8), the in-between formations (10), near the rounded point (12), and in the central base region about axis (9). These distortions often concentrate structural stresses in these areas which in turn can lead to a container breach if subjected to impact.

Typically these containers are manufactured from a polyethylene terephthalate (PET) polyester plastic material using a blow molding process that biaxially orients and sets its molecular structure. Other materials such as polyethylene naphthalate (PEN) or some combination of terephthalate and naphthalate based materials can also be used. While these are the most likely choices others may be considered as well.

Figure 2:
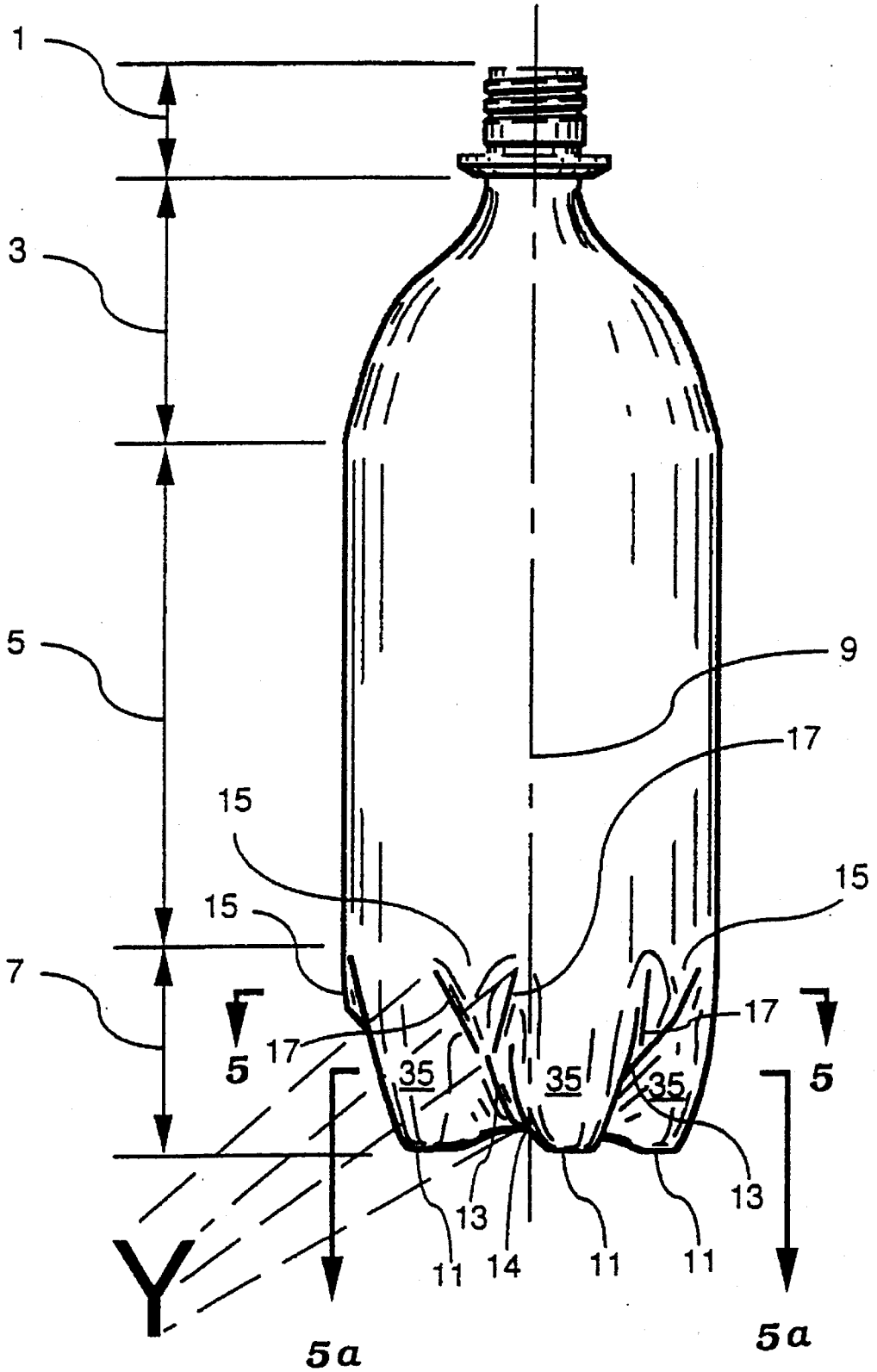
FIG. 2 is a side elevational view of a container with a base structure of the present invention.

The plastic container of the invention has a base structure, when manufactured with a reduced amount of material, that allows controlled distortion to occur while alleviating the above mentioned problems. This container as shown in FIG. 2 includes a neck finish (1) merging with a shoulder portion (3) which in turn smoothly merges with a sidewall portion (5) which in turn smoothly merges with a closed base structure (7). The container provides stable support when empty and when filled with a carbonated beverage and sealed. The base structure (7) permits controlled expansion to primarily occur in a upper circumferential region near the sectional line 5—5. Other areas of controlled expansion occur in a foot pad (11) of each hollow foot projection (35) and in a strap formation (13) between circumferential pairs of hollow projections. Controlled expansion also occurs in the container sidewall (5) and shoulder portion (3).

The base structure (7) is created by extending downwardly and smoothly inwardly from the sidewall (5) a minimum of three hollow projections (35) disposed about the longitudinal axis (9) terminating in a substantially planar foot pad (11) which in turn contacts a support surface, not illustrated, thereby providing support for the one piece container.

Figure 3:
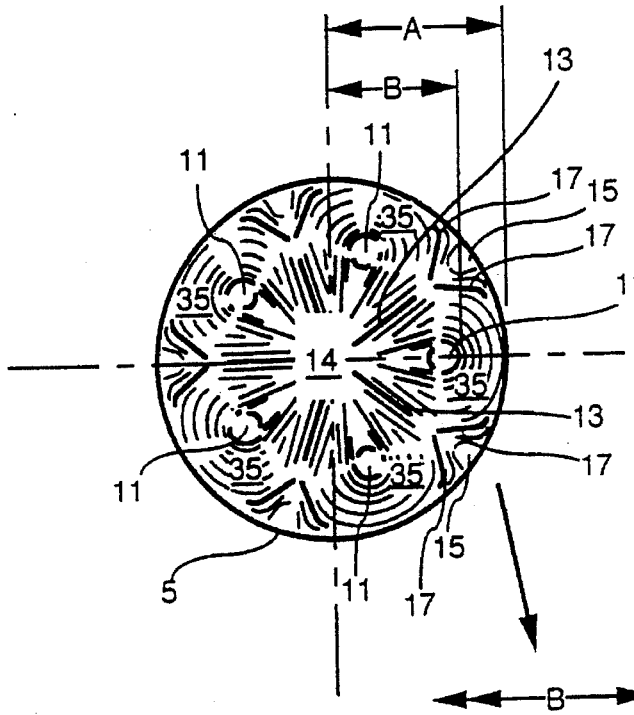
FIG. 3 is a bottom view of the container of FIG. 2 illustrating five identical circumferentially spaced downwardly hollow foot projections of the base structure.

FIG. 3 is a bottom view of the base structure (7) of FIG. 2. Separating each circumferentially adjacent pair of hollow projections is a strap formation (13) which in turn is partially separated at its upper end by a wedge formation or deformable region (15) to form two diverging and separated strap formations (17). Together the strap formation (13) and the separated strap formations (17), when viewed longitudinally (FIG. 2), assume a shape similar to a letter Y. In FIG. 3 the shape and features of a hollow projection (35), a foot pad (11), a strap formation (13), a pair of separated strap formations (17), and a wedge formation (15) is repeated five times and evenly disposed about the center of the container. Five supporting feet is the preferred embodiment of the invention, but those skilled in the art will recognize the invention is not limited to five. Also shown is a central region (14) of base structure (7).

Figure 4:
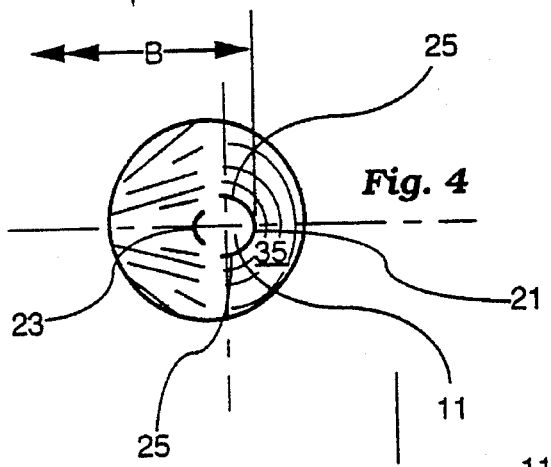
FIG. 4 is an enlarged bottom view of a foot pad of one downwardly hollow projection of the base structure of FIG. 3.

Preferably the hollow projections (35) smoothly blend to the foot pad (11) with a substantially circular shaped boundary as shown in FIGS. 3 and 4. The foot pad (11) has an outer edge (21), an inner edge (23), and two side edges (25). Distance A is a distance from the center of the container to the sidewall (5). Distance B from the center of the container to the outer edge (21) of foot pad (11) or outer side of the foot is preferably 70 percent of distance A or greater. This positioning of the foot pads will provide the wide stance needed for improved stability.

Control of wall thickness within the foot pad is critical in an extremely lightweight container, particularly a container with widely stanced feet. Wall thickness of the foot pad (11) will be thin relative to other areas. While the amount of material is adequate to safely hold the carbonation pressure, relatively vast differences in the wall thickness within the foot pad area, if permitted to occur, will allow an un-uniform expansion from the pressurization which in turn will create a crease or fold in the foot. This crease presents an aesthetically unpleasing shape and will concentrate stresses that may allow the foot to burst if subjected to impact.

Figure 5:
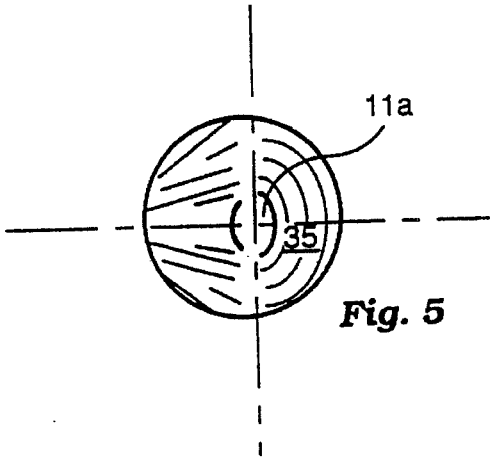
FIG. 5 is an enlarged bottom view of an alternative foot pad.
Figure 6:
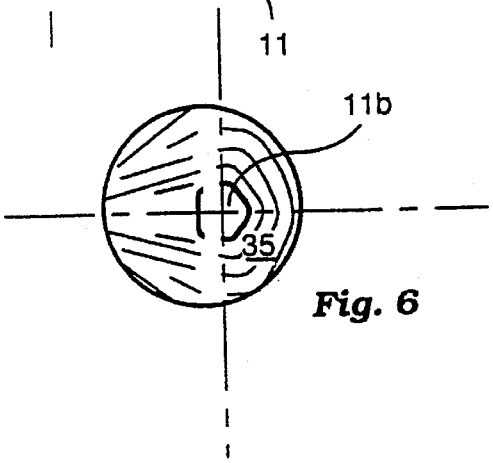
FIG. 6 is an enlarged bottom view of another alternative foot pad.

The preferred circular shape as shown in FIGS. 3 and 4 helps to create a more uniform material distribution or wall thickness within the foot pad (11), but this is not the only shape which can be used to achieve this distribution. FIG. 5 illustrates an alternative foot pad (11*a*) shape which is substantially oval. FIG. 6 illustrates an alternative foot pad (11*b*) with a rounded somewhat polygonal character. The various surfaces of the various shapes within the container must merge and smoothly blend together. By definition this requires additional surface arcs and curves that can mask a strict definition of a particular shape. In FIG. 6 the polygonal shape may have one or more sides that are a broad arc separated by a relatively sharper radius. While this is not a true polygon, to the eye, the character of the shape will suggest a polygon.

Figure 7:
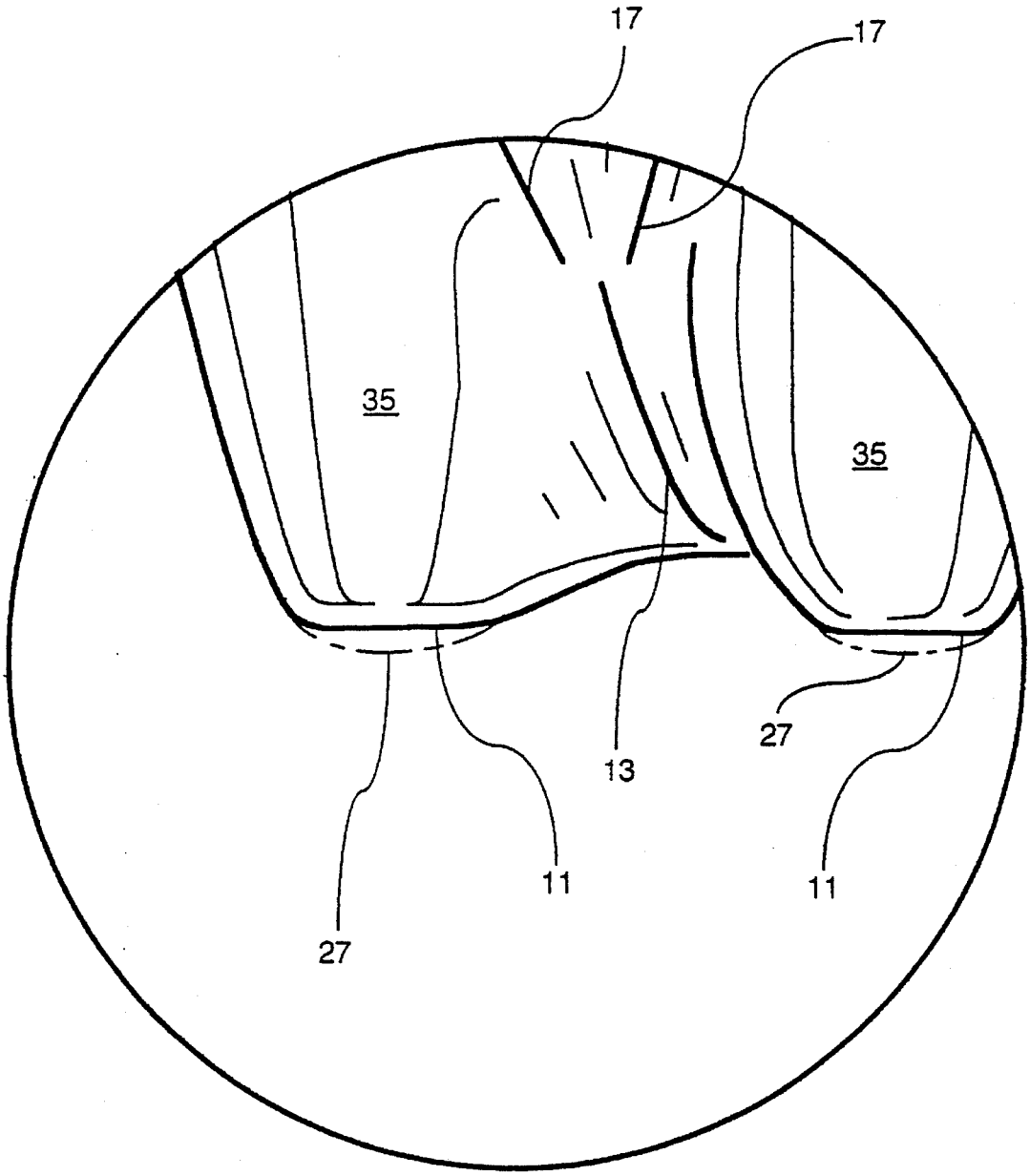
FIG. 7 is an enlarged elevational view of an area between a pair of downwardly hollow foot projections.

The substantially planar foot pad (11) shape (as shown in FIG. 7) is the shape as manufactured. In combination with the wide stance, it contributes to the stability of the container in handling equipment before and during container filling. Once the container is filled with a carbonated beverage and sealed the foot pad (11) in a controllable fashion expands to assume a somewhat flat hemispheroidal shape (27) without creases or folds or other distortions which will detract from container stability. This is particularly true with the pad shape described above having a circular boundary.

Figure 13:
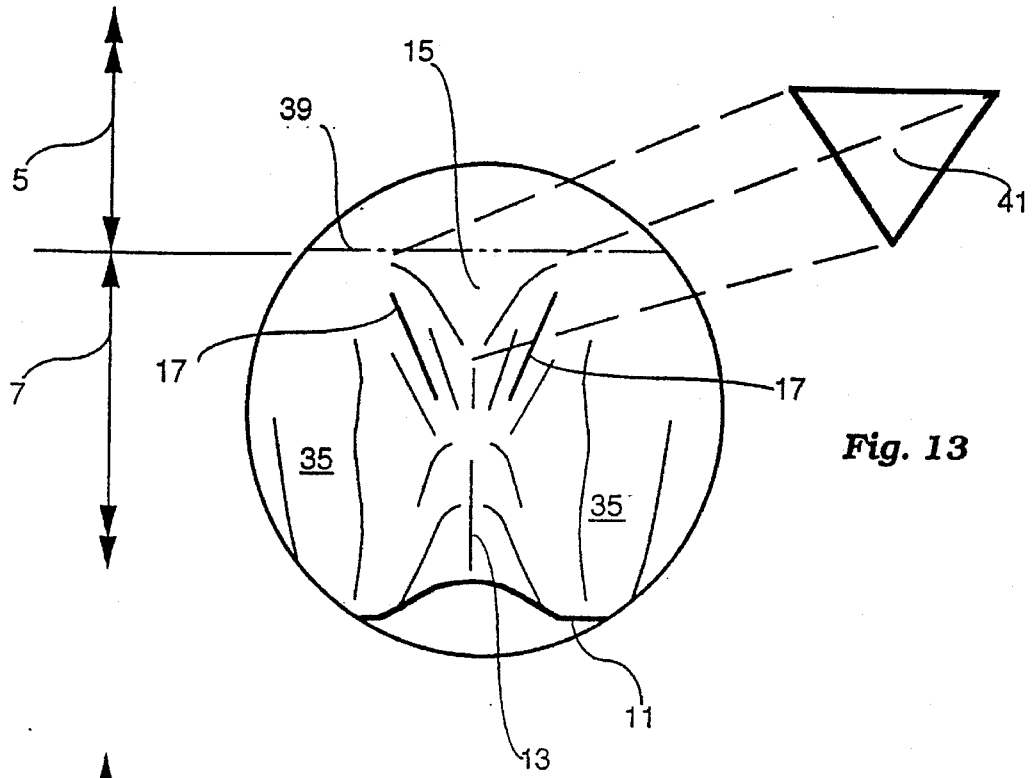
FIG. 13 is an enlarged elevational view of a wedge formation between a pair of downwardly hollow foot projections essentially as seen in FIG. 2, including an illustrated elemental shape as it generally appears to the eye.
Figure 14:
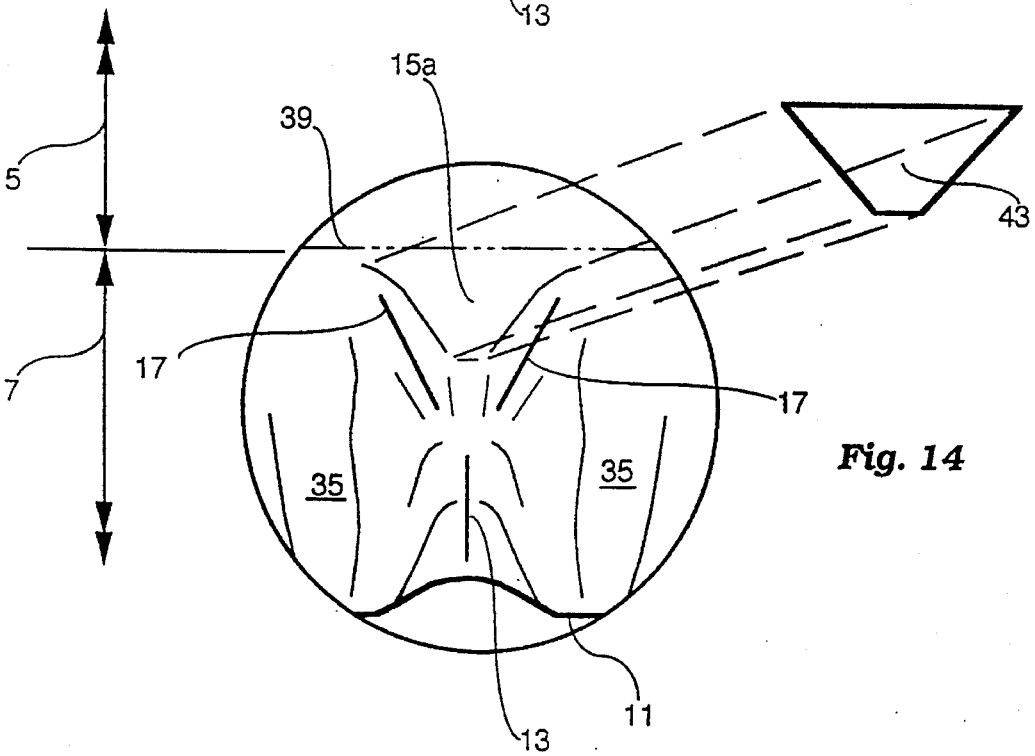
FIG. 14 is an enlarged elevational view of a wedge formation alternative.

Turning to FIGS. 13 and 14, an enlarged segment of the base formation of the invention is illustrated. The wedge formation (15) merges from the sidewall portion (5) and is positioned circumferentially equal distance from an adjacent pair of hollow projections (35). The strap formation (13) is separated by the wedge formation (15) to create separated strap formations (17) which in turn helps to distribute the forces of pressurization to the sidewall portion (5). Without this wedge formation (15) and separated strap formation (17) pressurization will concentrate forces in an area near the rounded point like shape (12) of prior art FIG. 1.

Figure 9:
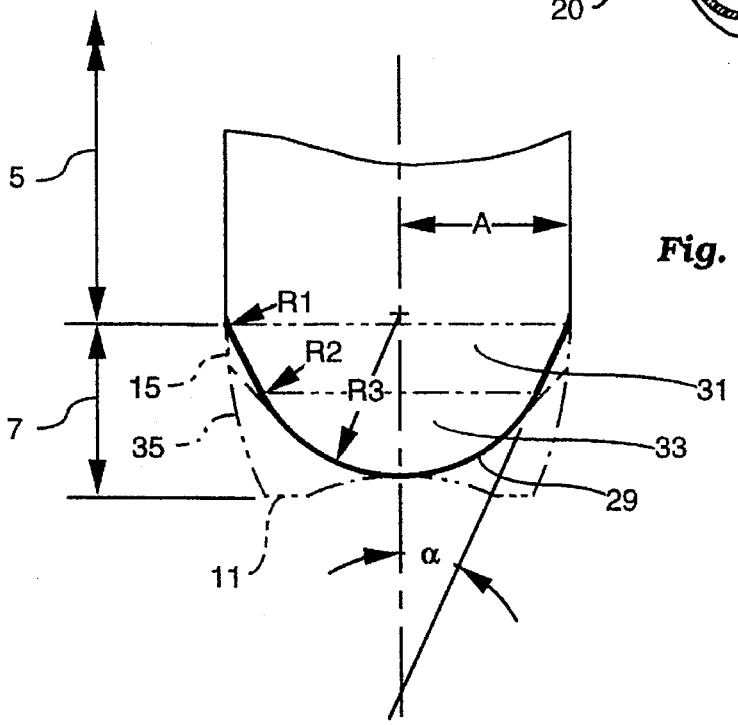
FIG. 9 is an elevational view of the base structure illustrated in phantom so as to better view a bottom wall from which the downwardly hollow foot projections project.

To the eye the wedge formation (15) (FIG. 13) preferably has a shape with a rounded inverted triangular character (41) particularly when considering an imaginary line (39) created by the division of the base structure (7) merging from the sidewall portion (5). As seen in FIGS. 2, 9 and 13, the wedge formation 15 protrudes outwardly from between the separated strap formations 17 giving the wedge formation 15 a raised or pyramidal characteristic relative to the immediately adjacent portions of the base structure.

An alternative wedge formation (15*a* FIG. 14) has a shape with a rounded inverted trapezoidal character (43) particularly when considering the imaginary line (39) created by the division of the base structure (7) merging from the sidewall portion (5).

FIG. 9 illustrates a bottom wall (29) of the base structure (7). The hollow projections (35) and wedge formations (15) are represented with phantom lines to better illustrate the shape of the bottom wall (29). Bottom wall (29) is a foundation shape from which the hollow projections (35) and wedge formations (15) extend. Once extended little of the bottom wall (29) configuration remains; nevertheless, the bottom wall (29) configuration is an important element of the base structure configuration after the container is filled with a carbonated beverage and sealed.

The bottom wall (29) is shaped from an inverted truncated conical section (31) with a side angle a smoothly merging with a radius R1 from the sidewall portion (5). Smoothly merging downwardly with radius R2 from the conical section (31) is a spherical segment (33) with radius R3. Radius R3 can be either less than, equal to, or greater than dimension A. The surface of conical section (31) is not tangential to the surface of spherical segment (33).

Figure 10:
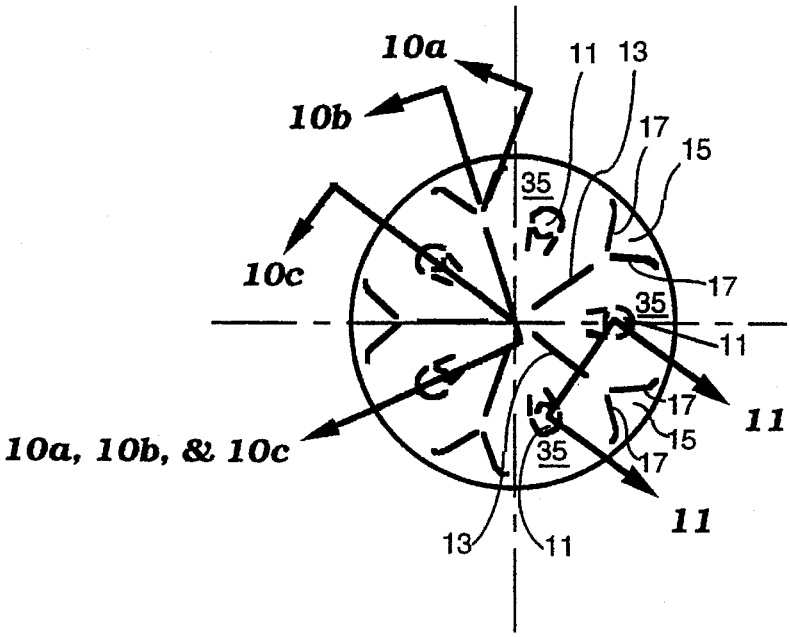
FIG. 10 is a bottom view similar to FIG. 3 except that most shading detail is removed to better illustrate the position of section 11—11.
Figure 11:
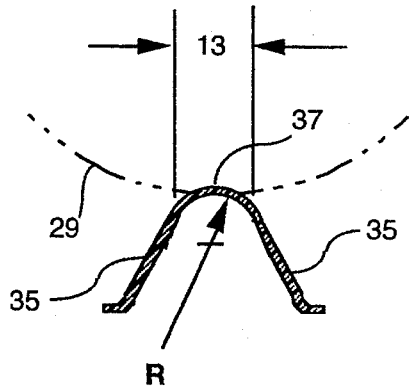
FIG. 11 is an enlarged sectional view as seen along line 11—11 of FIG. 10 illustrating a shape for the area between a pair of downwardly hollow foot projections.

FIGS. 10 and 11 illustrate a view of the strap formation (13) preferred. FIG. 10 is a bottom view of the base structure identical to FIG. 3 except that most contour lines depicting shape have been eliminated to better show section 11—11 location. FIG. 11 is an enlarged partial cross sectional view of the strap formation (13) and its relationship to the bottom wall (29). The strap formation (13) is actually a transition zone with a radius between adjacent pairs of hollow projections (35) and in close proximity to the bottom wall (29). Point 37 is the only remaining portion of the strap formation (13) in common with the bottom wall (29) when viewed in FIG. 11.

FIG. 10*a* illustrates a partial vertical sectional view of the strap formation (13) relative to the separated strap formation )17), the wedge formation (15) and the hollow projection (35). FIG. 10*b* illustrates a partial vertical sectional view of the strap formation (13) and the wedge formation (15) relative to the hollow projection (35). FIG. 10*c* illustrates a partial vertical sectional view of the hollow projection (35) relative to the central region (14) of base structure (7).

In the base structure (7), the strap formation (13) extends from the central region (14) to the corresponding separated strap formations (17). If a series of vertical sections are taken through the base structure 7 progressing along the strap formation 15 and separated straps formations 17, it would be seen that strap formations 15 and separated strap formations 17 define a series or locus of points (37) which correspond with the bottom wall (29).

Figure 12:
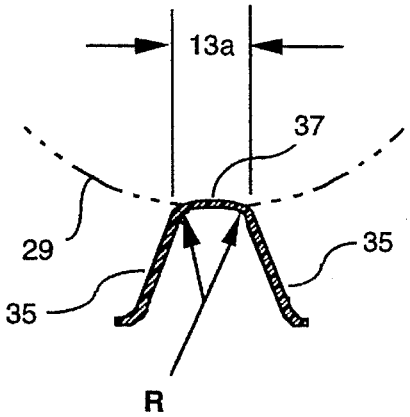
FIG. 12 is an enlarged sectional view essentially as seen along line 11—11 of FIG. 10 illustration an alternative shape for the area between a pair of downwardly hollow foot projections.

FIG. 12 is an alternative strap formation (13*a*) with a somewhat flat character and with two somewhat sharper radii merging from the hollow projections (35).

Although not illustrated in cross section, the cross sectional shape of the separated strap formations (17) will assume the same relationship as the strap formation (13) as shown in FIGS. 11 and 12.

Figure 8:
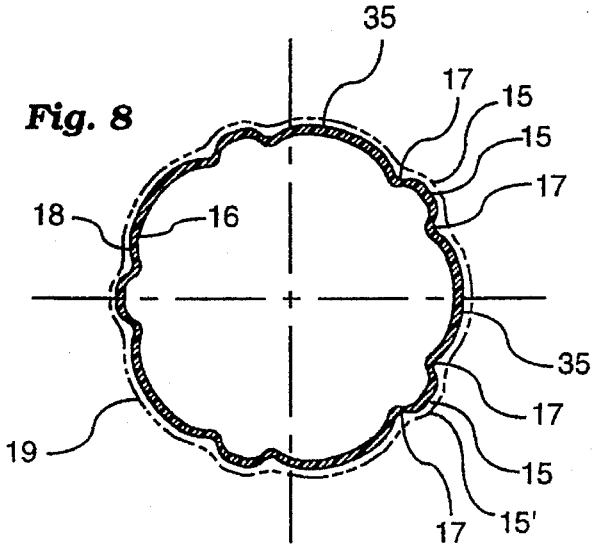
FIG. 8 is a sectional view as seen along line 8—8 of FIG. 2.

Turning now to FIG. 8 there is shown a cross sectional view of base structure (7) along line 8—8 in FIG. 2. Details lying beyond the cross section taken are omitted for clarity. Likewise the repeating features of the hollow projections (35), separated strap formations (17), and wedge formations (15) are not all numbered. A grouping of one set of these features, including two separated strap formations (17), is repeated five times, and each group is circumferentially evenly spaced. The cross sectional view clearly illustrates an inside surface (16) and an outside surface (18).

Upon pressurization with a carbonated beverage the circumferential region of the base structure as shown in FIG. 8 easily expands to assume a smoother more rounded shape as shown by phantom line (19) representing a new position for the outside surface (18). The degree of smoothing is dependent on the amount of pressure applied by the beverage. In an extreme situation the separated strap formations (17) will become difficult to detect and the wedge formation (15) will become a rounded bulge (15'). It appears that this expansion allows a pivotal force to be applied to the relatively rigid strap formations (13) with the upper portion of the strap formation (13) being moved outward and the lower portion of the strap formation being moved upward allowing the central region (14) to initially move upwardly relative to the support foot pads (11). As pressure quickly continues to build inside the container the shoulder portion (3) and sidewall portion (5) expand slightly radially outward. The central region (14) returns to approximately its original position. The hollow projections (35) appear to thrust slightly outward in a somewhat radial direction while the strap formations (13) appear to flatten slightly. The foot pads (11) assume a slightly somewhat hemispheroidal shape while the base structure (7) provides a stable container support.

Figure 18:
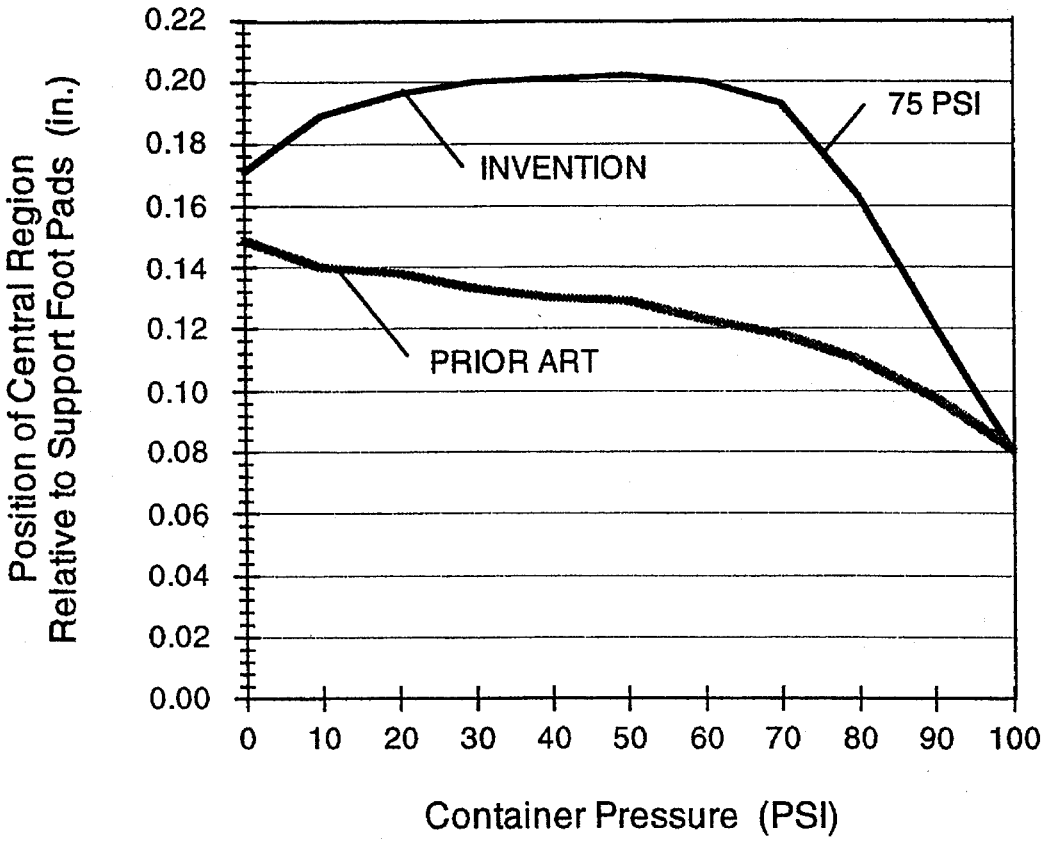
FIG. 18 is a graphical representation, at various levels of pressure within the container, of central region positions relative to the support foot pads.

FIG. 18 is a graphical representation, at various levels of pressure within the container, of the position of the central region (6, 14) of the prior art and present invention relative to the respective support foot pads (4, 11). The position of central region (6) of a tested prior art container (FIG. 1) steadily decreases as pressure increases. The position of central region (14) of a tested container of this invention (FIG. 2) initially increased before decreasing as pressure increases. At 75 PSI, the pressure of a typical carbonated beverage container filled and sealed at room temperature, the central region (14, FIG. 2) is at a position approximately equal to its position at 0.0 PSI.

Figure 8A:
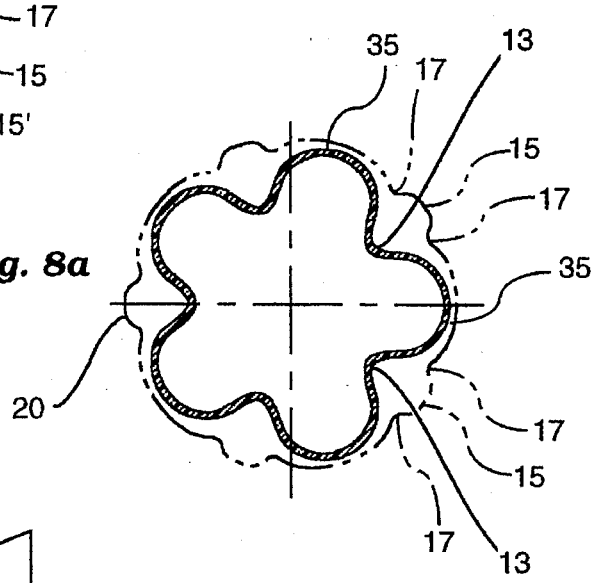
FIG. 8*a* is a sectional view as seen along line 8*a*—8*a* of FIG. 2.

FIG. 8*a* is a cross sectional view of base structure (7) along line 8*a*—8*a* in FIG. 2 clearly illustrating strap formation (13) position relative to the hollow projections (35). Phantom line (20) represents the outer surface (18) of section 8—8 of FIG. 8 and illustrates the separated strap formations (17) and wedge formation (15) in relationship to strap formation (13) and hollow projections (35).

FIG. 15 illustrates a modified form of the wedge formation (15 FIG. 13) and the separated strap formations (17), wherein two or more smaller wedge formations (15*b*) separate strap formation 13 into three or more separated strap formations (17).

Figure 16:
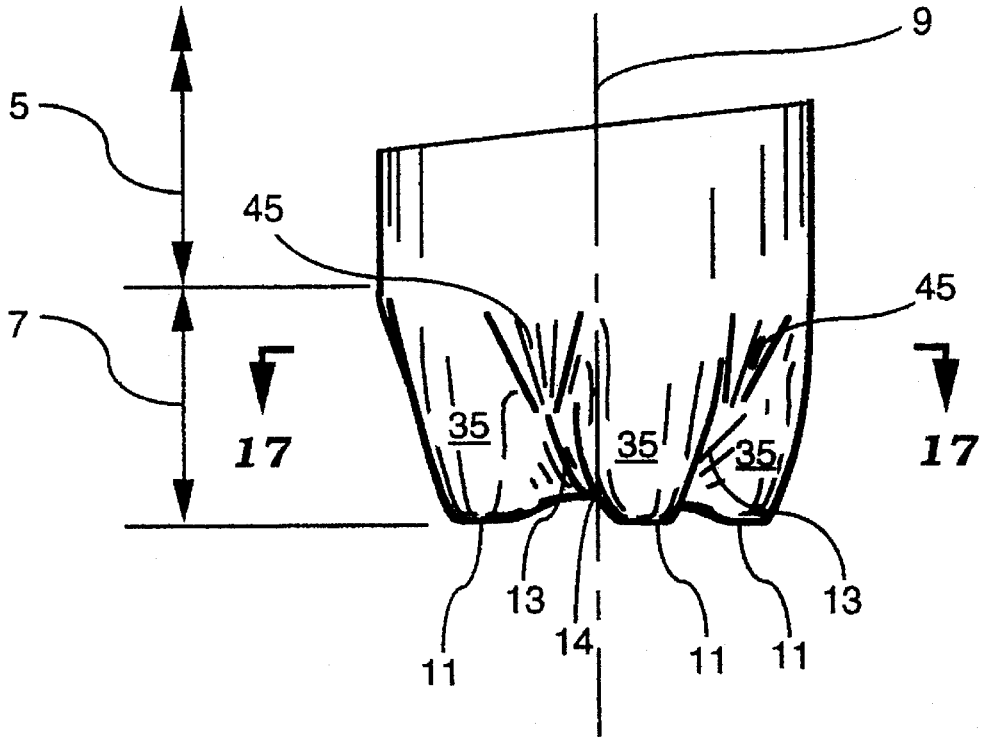
FIG. 16 is a partial side elevational view of an alternative configuration of the base of the present invention.
Figure 17:
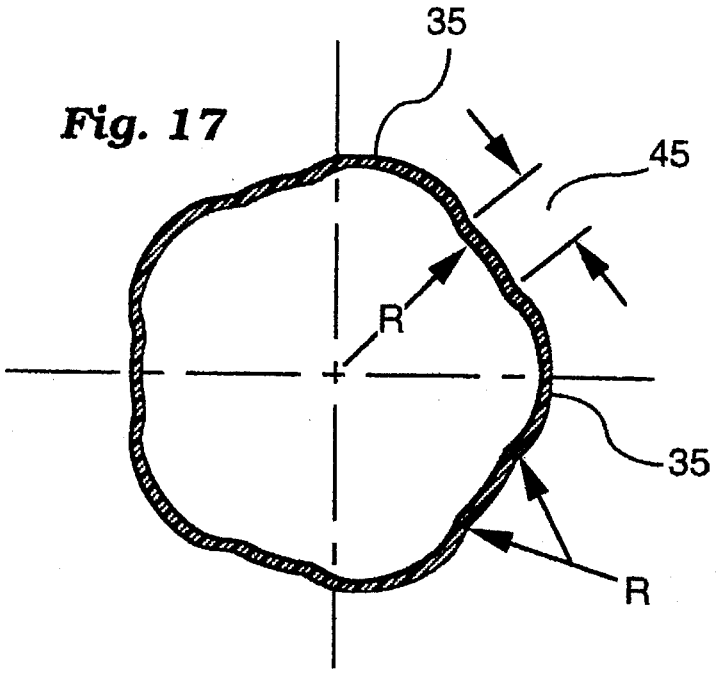
FIG. 17 is a sectional view as seen along line 17—17 of FIG. 16.

FIGS. 16 and 17 illustrate an alternative configuration of the base structure (7), wherein the strap formation (13) extending substantially radially from the central region (14) merges with a fan shaped area (45) which in turn merges with the container sidewall (5). The fan shaped area (45) forms a section in common with the bottom wall (29, FIG. 9) resulting in a gentle radius as shown in FIG. 17. Also shown are hollow projections (35) merging with a radius to the fan shaped areas (45).

While the above description discloses the preferred embodiment of the invention, it will become apparent to those skilled in the art that modifications, variations, and alterations may be made without deviating from the invention's scope and spirit as defined in the following claims.

What is claimed is:

1. A plastic blow molded biaxially oriented carbonated beverage container comprising:

a body including a neck finish merging with a shoulder portion which in turn merges with a sidewall portion which in turn merges with a base structure; a longitudinal axis defined and extending centrally through said body, said base structure having at least three downwardly projecting feet circumferentially disposed about said longitudinal axis and said base structure to support said container, said base structure also including a relatively rigid strap formation extending substantially radially outward and upward from a central region of said base structure and between said strap, said strap formation being divided at an upper end thereof into divergent separated strap formations which in turn merge with said sidewall portion of said container, a deformable region located between said separated strap formations and radially outward of said feet, said deformable region being adapted to bulge outward when said container is pressurized and said strap formations being pivotable about said feet as a result of said deformable region bulging outward when pressurized thereby moving said upper ends of said strap formations outward and said lower ends of said strap formations and said central region of said base upward.

2. A container as recited in claim 1 wherein said plastic is polyethylene terephthalate.

3. A container as recited in claim 1 wherein each said strap formation is divided into at least three separated strap formations.

4. A container as recited in claim 1 wherein said deformable region and said separated strap formations are disposed such that when the container is pressurized they deform smoothly and form a rounded bulge.

5. A container as recited in claim 1 having five feet circumferentially disposed about said longitudinal axis and said base structure.

6. A container as recited in claim 1 wherein each of said feet has an outer side, an inner side, and two lateral sides; said outer side being spaced a radial distance from said longitudinal axis that is greater than or equal to 70 percent of the distance from said longitudinal axis to said sidewall portion.

7. A container as recited in claim 6 wherein each of said feet has a generally planar surface adapted to contact a support surface, said planar surface merging with said outer, inner and lateral sides of said feet to generally define a rounded periphery.

8. A container as recited in claim 7, wherein when said container is pressurized said planar surface deforms into a generally hemispheriodal shape.

9. A container as recited in claim 7 wherein said planar surface has a generally circular periphery.

10. A container as recited in claim 7 wherein said planar surface has a generally oval periphery.

11. A container as recited in claim 7 wherein said planar surface has a generally polygonal periphery.

12. A container as recited in claim 1, having a nominal capacity of two liters and a weight of less than 50 grams.

13. A container as recited in claim 12, wherein said weight is less than 48 grams.

14. A container as recited in claim 12 wherein said plastic is polyethylene naphthalate.

15. A container as recited in claim 1 wherein said deformable region is a wedge formation being trapezoidal in shape.

16. A container as recited in claim 1 wherein each of said strap formations together with said separated strap formations at the upper end thereof forms a Y-shape.

17. A container as recited in claim 1 wherein said deformable regions are triangular in shape.

18. A container as recited in claim 1 wherein said deformable regions are fan shaped.

19. A container as set forth in claim 1 wherein said base structure is formed with a spherical section including said central region, said spherical section merging into a truncated conical section which in turn merges said side wall portion.

* * * * *